US005496411A

United States Patent [19]

Candy

[11] Patent Number: 5,496,411

[45] Date of Patent: Mar. 5, 1996

[54] ULTRASONIC VIBRATION GENERATOR AND USE OF SAME FOR CLEANING OBJECTS IN A VOLUME OF LIQUID

[75] Inventor: Bruce H. Candy, Basket Range, Australia

[73] Assignee: Halcro Nominees Pty. Ltd., Australia

[21] Appl. No.: 157,116

[22] PCT Filed: Jun. 12, 1992

[86] PCT No.: PCT/AU92/00276

§ 371 Date: Dec. 6, 1993

§ 102(e) Date: Dec. 6, 1993

[87] PCT Pub. No.: WO92/22385

PCT Pub. Date: Dec. 23, 1992

[30] Foreign Application Priority Data

Jun. 14, 1991 [AU] Australia ..... PK6691

[51] Int. Cl.[6] ..... B08B 3/12

[52] U.S. Cl. ..... 134/1; 134/34; 134/184; 310/316; 310/317

[58] Field of Search ..... 134/1, 18, 34, 134/184; 366/127; 310/316, 317

[56] References Cited

U.S. PATENT DOCUMENTS

| | | | |
|---|---|---|---|
| 2,594,841 | 4/1952 | Arndt | 310/316 |
| 3,975,650 | 8/1976 | Payne | 310/316 |
| 4,736,130 | 4/1988 | Puskas | 310/316 |
| 4,868,445 | 9/1989 | Wand | 310/316 |
| 5,076,854 | 12/1991 | Honda et al. | 134/1 |
| 5,218,980 | 6/1993 | Evans | 134/1 |
| 5,276,376 | 1/1994 | Puskas | 310/317 |

*Primary Examiner*—David L. Lacey
*Assistant Examiner*—Sean Vincent
*Attorney, Agent, or Firm*—Adams & Wilks

[57] ABSTRACT

An apparatus and method for ultrasonic cleaning is disclosed in which a transducer (35) in a liquid bath is driven by electronic circuitry causing rapid change of frequency to limit development of high concentration for any significant period of time. The electronic circuitry uses two field effect transistors (19 and 20) driving a square wave into an inductor (31) and capacitor (32) in series with a transformer inductor (33) which is coupled in parallel to the transducer (35) the inductor (31) and capacitor (32) and the transformer inductor (33) which is coupled in parallel to the transducer (35) being selected to be resonant at a mean driving frequency.

10 Claims, 1 Drawing Sheet

ULTRASONIC VIBRATION GENERATOR AND USE OF SAME FOR CLEANING OBJECTS IN A VOLUME OF LIQUID

BACKGROUND OF THE INVENTION

This invention relates to ultrasonic vibration generation and use.

Conventionally for ultrasonic cleaning an electrical to mechanical transducer, typically a piezo electric device, within a bath of liquid is driven by a fixed frequency oscillatory electrical signal which is used to provide ultrasonic vibrations within the liquid.

A commonly accepted theory explaining ultrasonic cleaning is that the ultrasonic energy creates cavitation bubbles within a liquid where the sound pressure exceeds the liquid vapor pressure at the particular operating temperature and pressure. The theory is that when the cavitation bubbles collapse, which action is very sudden and forceful, peak energy pulses act through the liquid to effect some cleaning result.

In tests now conducted by the present applicant, applicant has found that this mechanism rather than being a primary cleaning mechanism would appear not to be the most important mechanism acting and in fact previous acceptance of this theory has led to an attempt to mainly optimise ultrasonic frequencies so as to attain maximum power output, which causes standing waves to be established with attendant sound "hot spots" which promote cavitation bubbles.

Our tests have shown that if we rather than attempting to optimise power output by frequency selection for a significant period of time to promote cavitation, we arrange input into a cleaning fluid of the ultrasonic vibration in such a way that the energy input is homogeneously distributed throughout the cleaning fluid averaged over a short period of time then a very significantly improved cleaning effect can be achieved without having to increase the energy input required from the electronic power supply.

Further however this allows for a substantial reconsideration of the power supply necessary because of the reduced power requirements.

In U.S. Pat. No. 4,736,130 Puskas discloses an apparatus with seven controllable variables. These are 1.) the time duration of a power pulse train, which is followed by a 2.) time period of no activity for degassing, 3.) the time duration of individual power bursts during the power train period, 4.) the time duration of periods of no activity between the individual power bursts, 5.) the range of amplitude modulation of each power burst, 6.) the mean transmitted frequency, and 7.) a frequency modulation index.

Puskas states that in regard to 7.) "minimum and maximum frequencies of the sweep frequency function are preferably within a resonant range of the transducer." No limits are imposed on the frequency sweep rate.

In U.S. Pat. No. 4,398,925 Trinh et al. discloses an ultrasonic transmitting apparatus for removing bubbles in a fluid. It is disclosed that the transmitted frequency is swept from 0.5 kHz to 40 kHz and that the ratio between the low and high frequency limit should be at least 10 times. The sweep rate is "slow enough so that each bubble oscillates at least several cycles." U.S. Pat. No. 4,398,925 further teaches that if each frequency sweep is constrained to take about 10 seconds or more, then after about 15 minutes of continuous sweeping, most bubbles will be removed.

In U.S. Pat. Nos. 3,648,188, and 4,588,917 Ratcliff discloses a power oscillator with different resonant arrangements and positive feedback components to cause oscillation.

U.S. Pat. No. 4,864,547 describes means of producing a soft start and means to vary the power to the transducer.

Several phase locked loop arrangements are described so that a resonant frequency of the transducer is locked onto by the drive electronics. U.S. Pat. No. 4,748,365 is an example of this which describes means for searching for the load resonance point and then locking onto it.

OBJECT OF THE INVENTION

It is an object of this invention then to provide improvements relating to ultrasonic vibration apparatus and methods such that there is a better cleaning effect than hitherto available for a given power input.

SUMMARY OF THE INVENTION

In one form the invention can be said to reside in an assembly including a liquid container, at least one electrical to mechanical transducer positioned so as to effect transmission of ultrasonic vibration into the container, and a means to electrically drive said transducer, the assembly being characterized in that the said means are adapted to provide an electrical drive signal such that the ultrasonic vibration output of a transducer will effect an output the frequency of which is caused to be quickly changing over time.

The rate of frequency change is to be gauged as being in comparison to those previous disclosures where the purpose has been to promote intense concentration of energy to maintain ultrasonic "hot spots" or bubble removal. If in the present proposal cavitation bubbles are forming then the cleaning effect can be improved by making the frequency change rate faster.

The invention in another form can be said to rely on the method of effecting ultrasonic cleaning which comprises the steps of transmitting into a liquid container through at least one electrical to mechanical transducer positioned so as to effect transmission of ultrasonic vibration into the container an electrical drive signal such that the ultrasonic vibration output of a transducer will effect an output the frequency of which is quickly changing over time.

According to another aspect of this invention there is provided a method of effecting a generation of ultrasonic vibration which comprises effecting a drive of an electrical to mechanical transducer with electrical drive signals where the frequency is a plurality of different frequencies and the frequencies used are used in a recurring sequence which changes quickly.

Generally speaking the electrical impedance of a piezoelectric dielectric is capacitive for most frequencies. If a conventional amplifier is coupled to drive the transducer directly, in general a large reactive component current will flow from the said amplifier, unless the frequency selected is that at which the transducer's impedance happens to be resistive which may occur at the perhaps one or two of the transducer with tank and content's numerous resonances (not all the resonances if any will provide a purely resistive impedance at that frequency).

However as the impedance is highly dependent on many parameters as indeed set out previously, elaborate feedback type techniques may have to be used to locate a best resistive impedance with the attendant high cost and complex circuitry if indeed it might be possible.

One approach to assist in improving efficiency could be to connect an inductance across the transducer where the value selected would provide for resonance of the transducer inductance combination at the drive frequency. However where such an arrangement has been proposed there has been a circuit arrangement that results in a significant inefficiency because there is current flowing while a significant voltage still exists between an emitter and collector of a driving amplifier/oscillator such as the commonly used bipolar power transistor.

Hence, according to this invention there is provided as a further alternative that the drive electronics provide the drive electrical energy in the form of pulses. The advantage of this is that the drive devices that can then be used are switching type devices so that they can be either fully on or fully off and hence provide substantially little power loss.

This can in preference be a rectangular form of drive energy or a square wave form of drive energy.

In a particular case there can preferably be provided both a method which incorporates effecting a drive of a transducer by driving this with electrical pulses or otherwise resides in apparatus for this purpose which comprises pulse drive for the transducer.

If the drive electronics produces a square wave signal generated by solid state switching elements which alternately switch on to a positive or negative electrical current supply where the "on" resistance is low and the "off" resistance is high, and such that when the said signal is switched to the positive rail, a switch connected to the negative supply is "off" and when the signal is switched to the negative supply, the switch connected to the positive side is "off" and if the positive and negative supplies are of low impedance at a selected operating frequency or selected range of frequencies by means for example of a 2 decoupling capacitor connected between the supply rails then the drive electronics will produce very little heat. This presumes the absence of large harmonic currents.

If such a square wave was connected directly to the transducer, large currents would flow to charge and discharge the transducers capacitance. In a preferred form this may be overcome by placing a reactive element between the transducer and switching circuit such that the impedance to the harmonics is inductive. One way to implement this is to place an inductance between the transducer and the square wave source.

In a further preferred form the inductance is placed in series with a capacitance such that the resonance of this combination is selected to be approximately a selected mean operating frequency. If this is connected to a transducer/parallel inductance or transducer/parallel inductance/transformer combination described above, then two advantages are gained, namely efficient electronics without high harmonic currents, and the large transducer capacitive component is substantially cancelled.

Hence a low impedance square wave source which is switched alternately between the supply rails which feeds a series inductor/capacitor resonant at the mean operating frequency which in turn feeds the transducer with a parallel inductance selected to be resonant with the transducer capacitance has advantage in efficient electronics, no unnecessary substantial reactive currents flowing through the said switches and highly factory reproducible electronic sources.

To further reduce the dependence of the mean sound energy on the tank conditions described above, a swept frequency tends to have a net averaging effect on the mean transmitted power for a wide range of different tank conditions. That is the power peaks as the frequency sweeps through the resonances, but is low at frequencies not near the resonances. It should be pointed out that the resonances are very broad when the sound energy is high because the resulting non-linearities present a predominantly resistive component.

This swept frequency arrangement is most useful for low cost, high production ultrasonic units.

The resonant circuit arrangement with a low impedance square wave drive (mentioned above) has the property that the average current flowing to the drive circuit is dependent substantially only on the transducers resistive current as it's reactive current simply flows around the drive circuit without dissipating heat, that is through low resistance switches, a supply decoupling capacitor and through the non-dissipative resonant circuit. Hence, the net reactive current averages to zero.

BRIEF DESCRIPTION OF THE DRAWING

For a better understanding of this invention preferred embodiments will now be described with the assistance of drawings in which.

DETAILED DESCRIPTION OF THE PREFERRED EMBODIMENT

Figure 1:
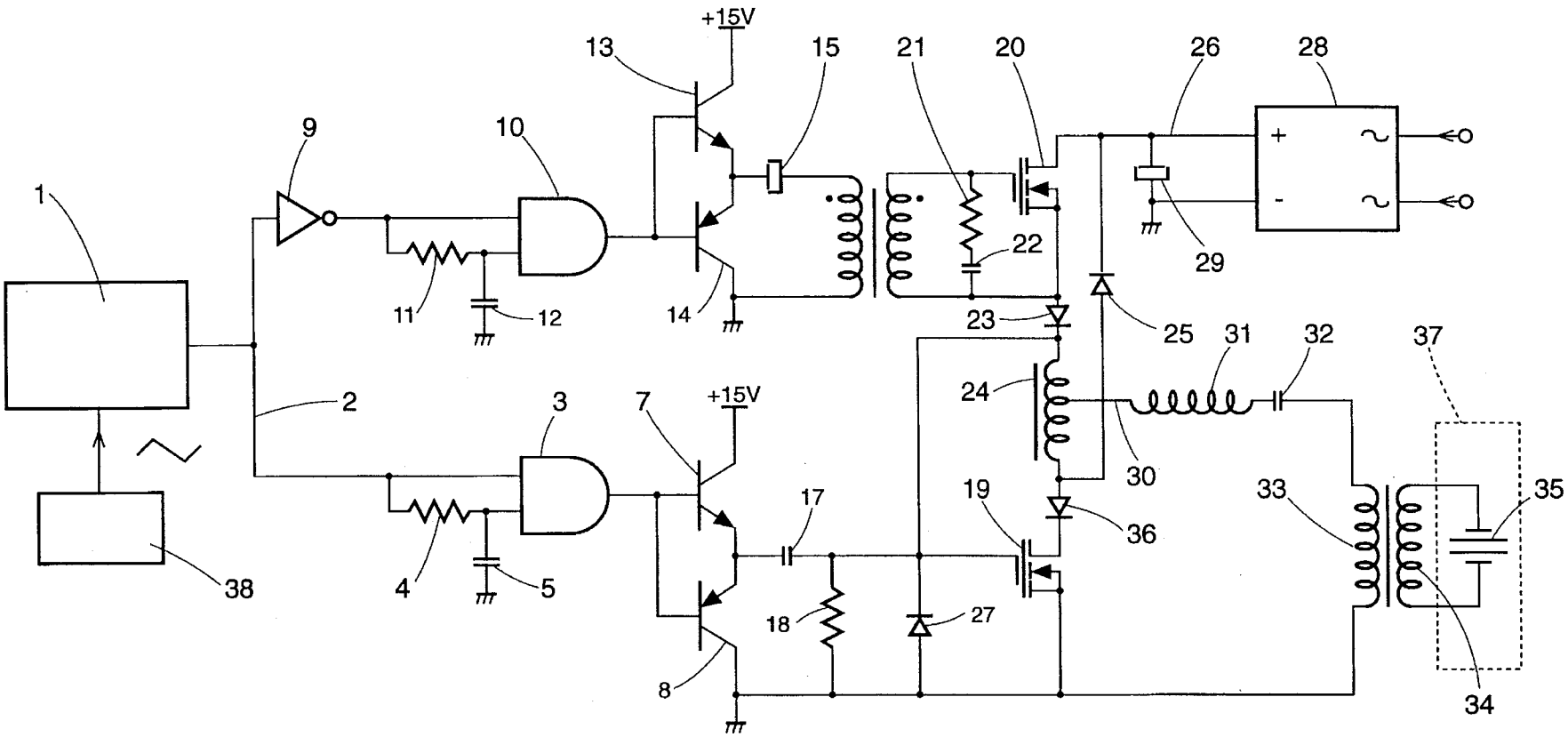
FIG. 1 is a circuit arrangement of an embodiment of the invention.

Referring to FIG. 1, the voltage controlled frequency source 1 feeds a square wave signal via its output 2 to a schmitt 2-input AND gate 3. One input is fed directly and the other is "delayed" by a short time constant RC filter consisting of a series resistor 4 and "integrating" capacitor 5 (10 k and 68 pf). The output is high only when both inputs are high. Hence there is a short delay in the output becoming high following a low to high transition at 2. Thus the output of 3 is of slightly longer low period than high. Similarly 2 is inverted by inverter 9 which then feeds another similar delayed circuit consisting of the corresponding 2-input schmitt AND gate 10, series resistor 11 and 'integrating' capacitor 12. The output of 10 is inverted relative to that of 3 and is also of slightly longer low than high duration. Note that the output of 3 and 10 are 'low' simultaneously both for a small fraction of the cycle following a high level in either said output. This is designed to guarantee that only 1 MOSFET (of the two MOSFETS 19 or 20) is turned on ate time as described later.

The AND gate 3 feeds an emitter follower buffer consisting of bipolar transistors 7 and 8 (BC368/9). The bipolar transistors 7 and 8 feed a decoupling capacitor 17 (47 nf) which is DC connected to ground via a resistor 18 (47 k). The 47 nf is in turn connected to the gate of the "pull-down" power MOSFET switch 19 (BUK 445-200A).

The output of AND gate 10 also feeds an emitter follower buffer consisting of bipolar transistors 13 and 14 (BC368/9) which in turn feed a pulse transformer 16 through capacitor 15. The pulse transformer's 16 output is connected to the gate and source of the "pull-up" power MOSFET 20. Also connected across the output of 16 is a 'damping' RC combination consisting of resistor 21 connected in series with capacitor 22 (220 ohms in series with 2.2 nfd) to reduce transients due to leakage inductance of 16 resonating with the MOSFET 20's input and feedback capacitance.

Diodes 23 and 36 protect the MOSFETS 19 and 20 in some operating circumstances. We have discovered that as all power FETs contain a parasitic diode which is normally reversed biased for most operations, and this diode typically has a reverse recovery time of a microsecond, and that the load impedance is resistive and either inductive or capacitive, this diode may be forward biased if diodes 23 and 36 are not placed in series with each FET. If this parasitic diode of one FET has current flowing through it when the other FET is turned on (via it's gate), the power supply will be effectively shorted out for about a microsecond and a very large destructive current will flow though the said parasitic diode and said turned on FET. If diodes 22 and 23 are fast recovery types (e.g. 20 nanosecond types) then at worst this high current will flow for at most 20 nanoseconds, but even this is unlikely as it will be difficult for either 23 or 36 to be turned on because the reactive current will be steered through diodes 25 and 27 which are also fast recovery types, and hence will limit the duration of high current. In practice, this very short (tens of nanoseconds) high current does not cause any undue stress to FETs, unlike a microsecond high current.

The drain of pull down MOSFET 19 is connected to the source of the pull-up MOSFET via a low valued inductor/transformer 24. This decreases current transients in the MOSFETs (19 and 20). A diode 25 is connected between the pull-down MOSFET's drain and the High Voltage supply rail 26.

This clamps the maximum drain voltage to the rail (about 150 V max for 110 V mains). Another diode 27 is connected between the source of the pull-up FET 20 and ground for the same corresponding reason. The High Voltage supply rail 26 is supplied by a full-wave rectifier 28 fed by main power with a decoupling and smoothing capacitor 29 connected between the High Voltage supply rail 26 and ground.

The mid-point of the low value inductor/transformer 24 feeds the output 30. At this point, the waveform is a square wave of mean frequency F1 (say typically about 43 kHz).

A series LC resonator 31 and 32 is connected between 30 and a inductor/transformer 33. The resonant frequency of 31 and 32 is set approximately F1 (say 100 nfd and 137 microH for 43 kHz). The secondary winding 34 of the inductor/transformer 33 is isolated from the rest of the circuit and connected to the ultrasonic transducer 35 which is located in a water and detergent containing bath 37. The inductance of the secondary winding 34 (primary open) is designed to be approximately resonant at F1 with the parallel capacitance of the transducer (about 1.67 mH with say a transducer capacitance of 8.2 nfd for 43 kHz).

The number of primary turns of the inductor/transformer 33 is selected to yield an appropriate transformer ratio so that a selected mean transmitter power is obtained. Thus the impedance at the input of the series LC resonator 31 and 32 looks resistive at a transducer series resonance. The advantage of this arrangement is that high frequency harmonics are filtered out (i.e. the switching part) and the (large) reactive current component (of the order of amperes) due to the (large) parallel transducer capacitance only flows around the transducer and secondary inductance 34 circuit. Note the extra current in the primary winding 33 and hence MOSFETs would be more than doubled in magnitude owing to this reactive component. This would produce several times the heat loss in the MOSFETs if it were not for the resonant inductance 34.

A voltage reference device 38 is connected to the voltage controlled frequency source 1 providing a sawtooth input so that the frequency modulation is thus controlled.

There is provided a variable frequency source 38 for supply of a control voltage into voltage controlled frequency source 1 which provides a signal which is a square wave and is swept linearly through the frequency range of 39 to 47 kHz (the range being swept from the lower frequency to the higher frequency at a repetition rate of at least 40 Hz, or at least 20 Hz from low to high and then high to low frequencies).

Features of the arrangement described am that there is provided an ultrasonic vibration generator in which them is an electrical to mechanical transducer connected in parallel with an inductance which is fed from a low impedance square wave source by way of a resonator (consisting of a series inductance and capacitance) the impedance of which is inductive at frequencies above resonance of the said resonator.

Current descriptions of ultrasonic cleaning describe how the energy in the tank causes cavitation, that is the liquid is transformed from the liquid phase into the gaseous phase because the sound pressure exceeding the liquid's vapour pressure at the operating temperature and pressure. When the cavitation bubbles collapse, the "force" of the collapse pulls dirt off the cleaning target.

We have discovered that it is possible to produce very intense cleaning action in tanks with dimensions of the order of cubic meters with powers as low as a few hundred watts using the above techniques.

Previous products have either used fixed frequencies or use variable frequency transmission in a phase locked loop arrangement to optimise output power so that once the said loop has locked, and the conditions in the ultrasonic bath have stabilized, then there is an effective constant frequency transmission. Some products have several transducers each operating at a different fixed or quasi-fixed frequency. If in these tanks the transmitted ultrasonic power is high, then cavitation occurs because standing waves are set-up which produce more intense regions in the tank than other areas.

Applicant has discovered that the problem with cavitation is that the cavitation sites act as catalytic areas where the sound energy is further concentrated, and that these sites typically may occur anywhere in the tank where the sound pressure is (or was) high and that the probability of a site occurring on the surface of the cleaning target is low. It should be noted that it is well known that ultrasonics by itself in a "neutral" fluid will cause inefficient cleaning, and that the presence of detergent or some other agent which chemically attaches itself or reacts with dirt is necessary for efficient ultrasonic cleaning. This fact does not comport with the established theory of cavitation being the main cause of ultrasonic cleaning.

Applicant believes that the main cause of the cleaning effect is the rapid back and forth movement of the transmission fluid across the surface of the cleaning target due to the ultrasonics. This fluid includes the detergent, which in turn has a chemical affinity with the dirt particles, and the back and forth movement of the cleaning chemical causes a shearing force on the dirt particles, which pulls them free from the cleaning target.

Hence it is desirable to keep the sound pressure at any local site in the bath below the level that cavitation can occur.

Significant cavitation bubbles requires time to occur. Hence a high sound pressure must be present at any point in the tank for more than a certain period of time before cavitation occurs. The higher the sound energy, the shorter this period.

Standing waves are the worst types of waves in terms of having high local energies persisting for significant "lengths of time."

To reduce standing waves our solution is to have the frequency quickly changing.

This can be achieved in several different ways:

The simplest way is to continuously rapidly sweep the transmitted frequency over a reasonably substantial frequency range. As the sound reflects off all surfaces, the sound reaching any one point in the tank will comprise of a range of different frequencies, where each component depends on the distance of the path travelled and the particular transmitted frequency when the said component left it's source. If the sweep is too slow then a slowly moving standing wave patten is set up and cavitation may occur because the local ultrasonic "hot spots" will persist for a sufficiently long period for cavitation to occur. Hence the necessity for a rapid sweep rate.

For example, if the frequency deviation is say plus and minus 10% of the mean frequency, then typically the sweep cycle time need be greater than about 20 Hz for a tank size of the order of a cubic meter.

Alternatively the frequency modulation may be random or quasi random, or indeed amplitude modulation also generates frequency side bands. Hence the said effective random range of frequencies may be generated by either frequency modulation, amplitude modulation, or both, so long as the range of frequencies at any one point in the tank change fast enough to eliminate the chances of obtaining intense sound pressures persisting for more than the period required at the particular sound pressure, temperature and vapour pressure to cause significant levels of cavitation.

For example, if the frequency deviation is say plus and minus 10% of the mean frequency, then typically the sweep cycle time need be greater than about 40 sweeps per second for a tank size of the order of a cubic meter. Note that if the frequency sweeps up then down, 40 sweeps per second can be described as an up and down seep rate of 20 Hz. Note too, that as described elsewhere, there are many bands of resonances, each band containing many resonances; that is there is not just "a" resonant frequency as described in many texts and patents. The sweep of about plus and minus 10% of the center frequency will typically cover most of a resonant band and may exceed the local limits of the said resonant band.

If the sweep range was increased by x%, and the number of sweeps per second decreased by x%, a similar result will occur. Hence a plus and minus 10% sweep range with at least 40 sweeps per second is mathematically equivalent to a sweep of at least "400% of the center frequency per second."

Alternatively the frequency modulation may be random or quasi random, or indeed amplitude modulation also generates frequency side bands. Hence the said effective random range of frequencies may be generated by either frequency modulation, amplitude modulation, or both, so long as the range of frequencies at any one point in the tank change fast enough to eliminate the chances of obtaining intense sound pressures persisting for more than the period required at the particular sound pressure, temperature and vapor pressure to cause significant levels of cavitation.

The problem with amplitude variation is the power limitations of the transducers. That is this may operate well at x watts for 100% of the time but may be overstressed at xy watts for 100/y% of the time- here the mean power is equivalent. In addition, amplitude pulses generate much noise if within the audio or sub audio band, which can be very irritating to people.

Hence continuous wave swept frequency modulation is more satisfactory for eliminating standing waves than is amplitude modulation or pulsed on and off periods.

The low impedance source consists of at least two solid state switches connected to an electrical current supply which is effectively decoupled at operating ranges of frequency.

Although this invention has been described by way of example and with reference to a preferred embodiment thereof it is to be understood that modifications or improvements may be made thereto without departing from the scope or spirit of the invention as defined in the appended claims.

I claim:

1. An ultrasonic vibration generator comprising: a transducer for converting an electrical signal into an ultrasonic vibration; and driving means for driving the transducer and controlling the frequency of ultrasonic vibration of the transducer to change with a repeated cycle during which the frequency of ultrasonic vibration changes within a predetermined range of frequencies linearly with time and continually in time such that during each cycle the frequency of ultrasonic vibration changes at a rate of at least 4 times a mean frequency of ultrasonic vibration per second in order to improve the efficiency of the ultrasonic vibration.

2. An ultrasonic vibration generator according to claim 1; in combination with a container for holding a liquid, the container being connected to an output of the transducer such that a liquid when in the container is caused to undergo ultrasonic vibration in order to effect ultrasonic cleaning of an object placed in the liquid.

3. An ultrasonic vibration generator according to claim 1; wherein the transducer is a piezoelectric transducer having an electrical impedance substantially capacitive in character over a wide range of frequencies, the ultrasonic vibration generator further comprising a first combination comprising a parallel connection of the transducer and a first inductor having an inductance set in accordance with the capacitive valve of the transducer so as to cause the frequency of electrical resonance of the first combination to be substantially that of the mean frequency of ultrasonic vibration.

4. An ultrasonic vibration generator according to claim 3; wherein the driving means includes means for providing electrical power to the first combination through a second combination comprising a second inductor having an inductance valve and a capacitor having a capacitance valve connected in series, the values of the components of the second combination being set such that the frequency of electrical resonance of the second combination is substantially that of the mean frequency of ultrasonic vibration.

5. An ultrasonic vibration generator according to claim 4; wherein the first inductor is a secondary winding of a transformer having a primary winding connected in series with the second combination.

6. An ultrasonic vibration generator according to claim 5; wherein the driving means is connected to a substantially direct current power source, the driving means including at least two field effect transistors each having an output path, a respective diode connected in series with the output path of each field effect transistor in order to minimize current flow through a slow recovery rate parasitic diode inherent in each field effect transistor of the driving means, and means for supplying square wave electrical pulses to the second combination.

7. An ultrasonic vibration generator according to claim 6; wherein one of the at least two field effect transistors functions as a pull-up transistor and at least one other of the at least two field effect transistors functions as a pull-down transistor.

8. A method of cleaning objects by ultrasonic vibration in a volume of liquid, comprising the steps of: placing an object to be cleaned in a volume of liquid, transmitting into the volume of liquid an ultrasonic vibration by providing an electrical signal to an ultrasonic transducer so as to cause the transducer to mechanically vibrate at an ultrasonic frequency; applying the output of the ultrasonic transducer to the liquid; and cyclically changing the frequency of the ultrasonic vibration within a predetermined range of frequencies linearly over time such that during each cycle the frequency of ultrasonic vibration changes at a rate of at least 4 times a mean frequency of the ultrasonic vibration per second so as to effect cleaning of the object situated within the volume of liquid.

9. A method of cleaning objects by ultrasonic vibration in a volume of liquid according to claim 8; wherein the electrical signal has a predetermined mean ultrasonic frequency and the transducer is a piezoelectric transducer, the electrical signal being a square wave for providing power through an inductor having an indicator value and capacitor having a capacitance valve connected in series and thereafter through a transformer having a secondary winding serving as an inductor having an inductance valve which is electrically connected in parallel with the piezoelectric transducer, the values of the respective inductors and capacitor and the capacitance of the piezoelectric transducer being set such that the respective parallel circuit in one case and the series circuit in the other are at resonance at the predetermined mean ultrasonic frequency.

10. A method of cleaning objects by ultrasonic vibration in a volume of liquid according to claim 9; wherein the ultrasonic frequency is continuously changed during each cycle over a range of frequencies, the range of frequencies being approximately 10% of the predetermined mean ultrasonic frequency.

* * * * *